US006234647B1

(12) United States Patent
Liu

(10) Patent No.: US 6,234,647 B1
(45) Date of Patent: May 22, 2001

(54) FULL COLOR PARAPET LAMP FOR ROAD OR BRIDGE

(76) Inventor: Limin Liu, Rm. 421 Building 63 Beiwencui Road, Donglin District, Shenyang City of Liaoning, 110015 (CN)

( * ) Notice: Subject to any disclaimer, the term of this patent is extended or adjusted under 35 U.S.C. 154(b) by 0 days.

(21) Appl. No.: 09/362,977

(22) Filed: Jul. 28, 1999

(30) Foreign Application Priority Data

Aug. 14, 1998 (CN) ..... 98238558

(51) Int. Cl.[7] ..... F21V 1/00

(52) U.S. Cl. ..... 362/235; 362/153; 362/153.1; 362/245; 362/219; 362/800; 313/110; 313/113; 313/17; 313/25

(58) Field of Search ..... 362/145, 153, 362/240, 225, 219, 252, 245, 246, 231, 800, 153.1; 313/570, 487, 17, 110, 25, 112, 26, 111, 113, 315, 169.1, 169.3, 493, 634, 318.02, 318.04, 635, 573

(56) References Cited

U.S. PATENT DOCUMENTS

Re. 22,848 * 3/1947 Wilder ..... 88/24
5,803,579 * 9/1998 Turnbull et al. ..... 362/83.1
5,865,533 2/1999 Liu .

* cited by examiner

*Primary Examiner*—Sandra O'Shea
*Assistant Examiner*—Bertrand Zeade
(74) *Attorney, Agent, or Firm*—Kilpatrick Stockton LLP

(57) ABSTRACT

The invention relates to a tubular lamp, particularly relates to a high-intensity parapet lamp for road or bridge, which can display various colors and is controlled by computer program. The cavity of the lamp is sealed with soldered illuminants and light-reflecting circuit board; the power supply wires pass through the inner tube and the ends of the power supply wires are connected to multi-contact connector assemblies. The lamp is lit up at night and is controlled by computer program to produce a flowing effect which can indicate the direction.

3 Claims, 1 Drawing Sheet

FULL COLOR PARAPET LAMP FOR ROAD OR BRIDGE

The invention relates to a tubular lamp, particularly relates to a high-intensity parapet lamp for road or bridge, which can displays various colors and is controlled by computer program.

Most of conventional parapets for road or bridge are of metal construction, and made of steel tubes with rectangular or circular cross-sections. They are often coated with various colors in order to attract people's attention. At night, since only when they can reflect light, can they be seen by people, it is difficult for them to be noticed. Therefore, they can not effectively prevent traffic accidents.

The object of the invention is to make the parapet of luminous tubular lamps controlled by computer program; while they are lit up at night, the light emitted by the parapet tubular lamps will produces a flowing effect which can indicate the direction.

Above object is achieved by following full color parapet lamp for road or bridge, consisting of an outer tube, an inner tube through which wires can pass, sealing brackets and a controller, characterized in that the cavity of the lamp is sealed with soldered illuminants and light-reflecting circuit boards insider; the power supply wires pass through the inner tube and the ends of the wires are connected to multi-contact connector assemblies. Moreover, the said outer tube of the lamp is made of red and/or white tube with red and/or white illuminants inside; the said illuminants are of homochromatic or tricolor bulbs, light-emitting diodes, other light sources or their combination selectively; the said controller is a single controller or a main controller with several sub-controllers selectively.

The advantages and effects of the present invention are as follows:

1. Instead of the light-reflecting parapet, the parapet for road or bridge is made of light-emitting parapet.
2. Computer program is used for making the parapet to indicating the direction for people and cars.
3. The lamp is provided with an inner tube through which power supply wires can pass, so that there is no wires outside and the lamp has a tidy and good appearance. The lamp is easy to assemble and disassemble as well.
4. The outer tube can be of various colors and can emit light of fill color.

The further detailed description of the present invention is given thereafter with reference to the figures.

Figure 1:
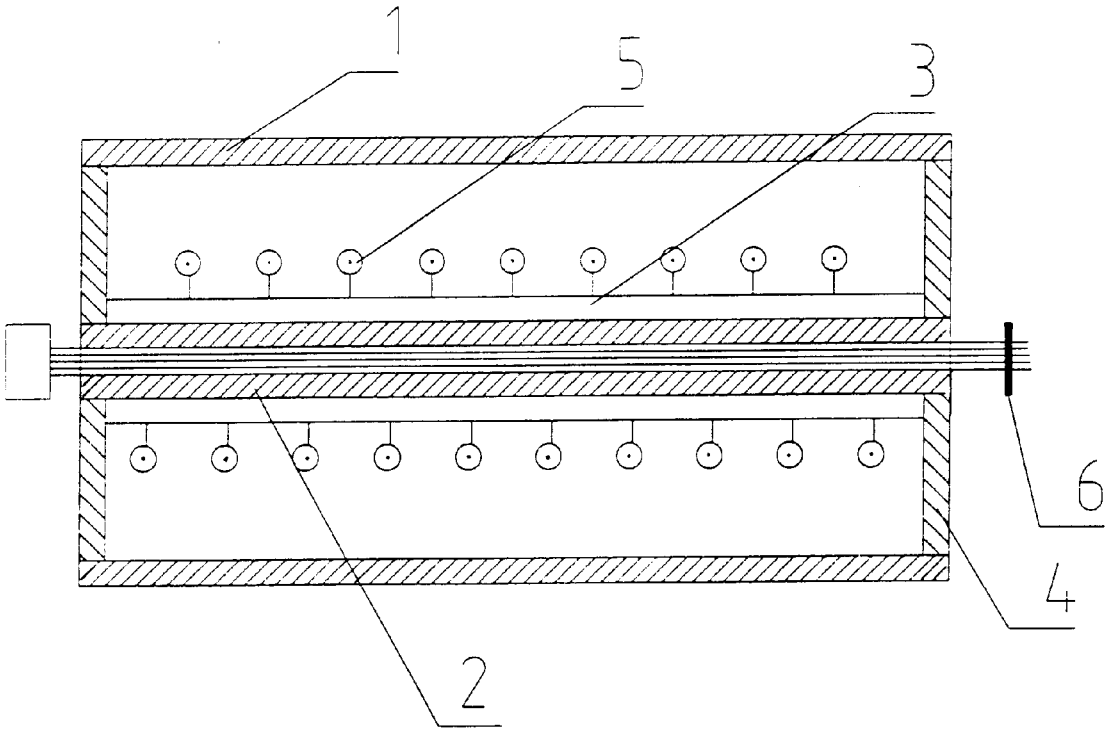
FIG. 1 is a longitudinal sectional view of the present invention.
Figure 2:
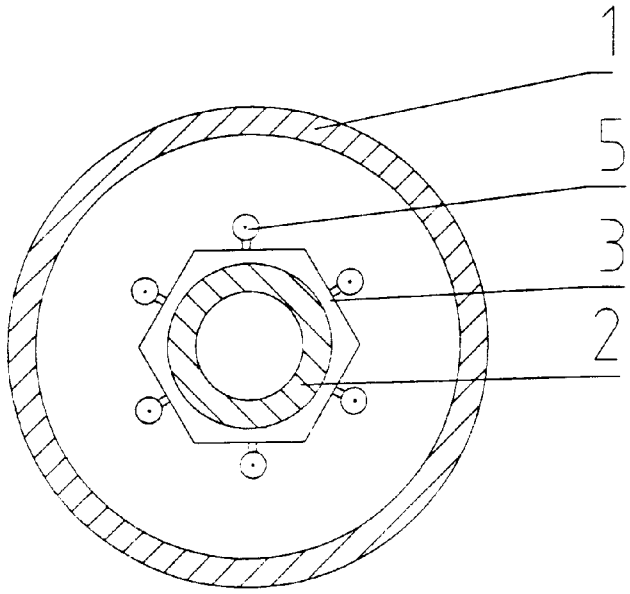
FIG. 2 is a cross-sectional view of the present invention.

Embodiment 1:

The tubular lamp is constructed as follows: Homochromatic and tricolor illuminants are attached to the light-reflecting circuit board in the form of plural groups and/or matrix in some order; The leads of these illuminants are connected each other in series and/or parallel and are soldered to the multi-contact connector assemblies. The connector assemblies are made of insulating material and are used to connect individual tubular lamps together into a lamp group. The control signal can be introduced from one end of the lamp group to control the brightness and color of any tubular lamp in the lamps group. The outer tube is made of transparent, high intensity engineering plastics diffused with pulverizing agent and transparent dye, so that it can be colorless or of some colors, with a property of allowing light to pass but preventing the direct-irradiating light to go though. The shape of the outer tube can be rectangular, circular, semi-circular, or prismatic. The light-reflecting circuit board connects pins of illuminants together and ensures illuminants to be fixed in the proper position. The surface of the circuit board should be coated or adhered with diffuse reflection layer in order to increase the light uniformity and brightness. The sealing bracket is located at each end of the outer tube. The bracket has a central hole and hermetically seals with the inner tube and the outer edge of the bracket seals with the inner wall of the outer tube. The power supply wires pass through the inner tube 2 which is a tube made of plastics material. This inner tube can have cross-section of circular, triangular or polygonal large enough for the power supply wires to pass. The outer wall of the inner tube is provided with supports for fixing the circuit boards. The number of the power supply wires is determined by the number of the groups and/or matrixes of the parapet tubular lamp. The wires are soldered to the multi-contact connector assembly 6. The light-reflecting circuit board 3 installed with illuminants 5 is fixed to the inner tube 2. The illuminants 5 is of homochromatic or tricolor bulbs, or LEDs selectively; the light-reflecting circuit boards 3 should be uniformly arranged outside the inner tube 2 in order to obtain uniform light emission. The more circuit boards installed, the better. Then the inner tube 2 is inserted into the outer tube 1, each ends of which are sealed with sealing brackets 4 to make the lamp waterproof and rustproof.

Embodiment 2 is a parapet lamp for road or brigde, which alternately flashes flowing red and white light.

The out tube 1 can be red-color outer tubes with red LEDs inside as their illuminants or white-color outer tubes with small incandescent lamps inside as their illuminants respectively. The red-color outer tubes and white-color outer tubes are arranged alternately. In the daytime, the alternately arranged red and white color tubes can act as a warning line, At night, they are lit up and the parapet becomes bright and is easy to be noticed. The tubes are controlled by the computer program to have an light pattern of nine bright and three dark which can move toward one direction. A main controller sends control signals to sub-controllers through telecommunication cables. In this way, separately and remotely controlling the different power supply for the parapets located in different area becomes workable. And the parapet system can also be synchronized as a whole system to give the synchronized change.

What is claimed is:

1. A multicolor parapet lamp, comprising:

an outer light-transmissive tube having first and second ends;

an inner tube disposed within the outer tube and having first and second ends;

sealing brackets respectively engaging the first and second ends of the outer and inner tubes so as to define an airtight sealed cavity between the outer and inner tubes;

plural illuminants disposed in the cavity on circuit boards supported on the inner tube;

electrical leads operatively connected to the illuminants and extending within the inner tube and through a sealing bracket so as not to interfere with the airtight seal; and the inner tube being light-reflective so as to direct illumination from the illuminants outwardly toward the outer tube.

2. The full color parapet lamp in accordance with claim 1, characterized in that the outer tube is made of red light-transmissive material with red illuminants inside or of white light-transmissive material with white illuminants inside.

3. The full color parapet lamp in accordance with claim 1, characterized in that said illuminants are of homochromatic or tricolor bulbs, light-emitting diodes (LED), other light sources, or their combination.

* * * * *